US007487624B2

(12) United States Patent
Baba

(10) Patent No.: US 7,487,624 B2
(45) Date of Patent: Feb. 10, 2009

(54) BREATHABLE WATERPROOF LAMINATE STRUCTURE

(75) Inventor: Shigeru Baba, Chiba (JP)

(73) Assignee: E.I. du Pont de Nemours and Company

( * ) Notice: Subject to any disclaimer, the term of this patent is extended or adjusted under 35 U.S.C. 154(b) by 823 days.

(21) Appl. No.: 11/030,673

(22) Filed: Jan. 6, 2005

(65) Prior Publication Data

US 2005/0204656 A1 Sep. 22, 2005

Related U.S. Application Data

(60) Provisional application No. 60/535,624, filed on Jan. 9, 2004.

(51) Int. Cl.
*E04B 1/62* (2006.01)
*E04B 2/00* (2006.01)

(52) U.S. Cl. ..... 52/783.19; 52/783.1; 52/783.11; 52/309.5; 156/71; 428/182; 428/184; 428/186

(58) Field of Classification Search ..... 52/309.1, 52/309.3, 293.3, 169.9, 169.14, 408, 61–63, 52/220.4, 783.11, 783.17, 783.18, 783.19, 52/788.1, 789.1, 798.1; 428/163, 167, 182, 428/184, 185, 186, 172, 198, 920, 921; 156/71, 156/210, 201, 264, 297, 298; 264/119, 286; 425/336

See application file for complete search history.

(56) References Cited

U.S. PATENT DOCUMENTS

| | | | | | |
|---|---|---|---|---|---|
| 1,970,746 | A * | 8/1934 | Ballenger et al. | ..... | 428/185 |
| 2,139,138 | A * | 12/1938 | Spafford | ..... | 428/154 |
| 2,164,137 | A * | 6/1939 | London | ..... | 52/330 |
| 2,184,137 | A * | 12/1939 | Brewer | ..... | 52/223.7 |
| 2,329,610 | A * | 9/1943 | Harman | ..... | 52/388 |
| 3,212,956 | A * | 10/1965 | Yoshikawa | ..... | 428/167 |
| 3,235,440 | A * | 2/1966 | Gould | ..... | 428/164 |
| 3,445,322 | A * | 5/1969 | Saiia et al. | ..... | 428/178 |
| 3,734,813 | A * | 5/1973 | Pohl | ..... | 428/162 |
| 4,840,515 | A * | 6/1989 | Freese | ..... | 405/45 |
| 5,308,691 | A | 5/1994 | Lim et al. | | |
| 5,692,348 | A * | 12/1997 | Ambrosino | ..... | 52/169.5 |
| 5,902,432 | A * | 5/1999 | Coulton et al. | ..... | 156/199 |
| 6,098,351 | A * | 8/2000 | Mills | ..... | 52/169.14 |
| 6,122,874 | A * | 9/2000 | Smerilli | ..... | 52/408 |
| 6,167,671 | B1 * | 1/2001 | Wilson | ..... | 52/654.1 |
| 6,230,468 | B1 * | 5/2001 | Klaus | ..... | 52/741.11 |
| 6,355,333 | B1 | 3/2002 | Waggoner et al. | | |
| 6,453,628 | B2 * | 9/2002 | Traxler | ..... | 52/169.14 |
| 6,672,016 | B2 * | 1/2004 | Janesky | ..... | 52/169.5 |
| 6,684,579 | B2 * | 2/2004 | Brunson et al. | ..... | 52/169.5 |
| 6,691,472 | B2 * | 2/2004 | Hubert | ..... | 52/169.5 |

FOREIGN PATENT DOCUMENTS

CA 2 244 625 A1 2/2000

(Continued)

*Primary Examiner*—Jeanette Chapman

(57) ABSTRACT

A breathable waterproof structure, made from a waterproof layer, mounted on an exterior wall side, that is a composite of a spun bonded non-woven sheet material with a resin layer on an interior surface of the sheet material; and a vent layer-forming member that is a corrugated spun bonded non-woven sheet material that is integrally attached to the waterproof layer by being multiply spot-adhered via the valleys of the corrugations and thereby generating the vent layer with a designated gap with the waterproof layer.

5 Claims, 4 Drawing Sheets

FOREIGN PATENT DOCUMENTS

| | | |
|---|---|---|
| DE | 29 38 574 A1 | 4/1981 |
| JP | 1992-059242 | 12/1991 |
| JP | HEISEI 8-120799 | 5/1996 |
| JP | 09001712 | 1/1997 |
| JP | 2001-20398 | 1/2001 |

* cited by examiner

BREATHABLE WATERPROOF LAMINATE STRUCTURE

BACKGROUND OF THE INVENTION

1. Field of the Invention

The present invention relates to an exterior wall structure for buildings and structures that provides excellent rain protection, moisture permeability and breathability.

2. Description of the Related Art

Conventional building methods for forming an exterior wall structure for buildings such as wooden dwelling houses and the like can be roughly broken down into two types: a traditional wet (mortar) finish and a siding finish. With the popularization of a breathable vent layer construction method, siding finishes are becoming the mainstream method. However, wet finishing has also been receiving renewed interest as the building exterior walls are becoming more customized and multifaceted. It should be noted here that the terms exterior and interior are relative as to location within a structure, but it is understood that exterior refers to a location closer to the outside of a building whereas interior refers to a location closer to the inside of a building. Regardless of which construction method is used, for the durability of the building some measures are required to prevent any water leakage from the outside. For example, mortar finishes warrant a structure wherein a breathable waterproof sheet is attached to the exterior surface of an exterior wall base material, such as gypsum board, concrete, plywood, and the like and wherein on the exterior side thereof are mounted struts, studs, or fixed or random length furring strips, spaced at suitable intervals to generate a continuous vent layer over the entire surface of the waterproof-sheet-covered base material. Further, on top of the aforementioned structure, a lath screen is mounted, followed by applying cement mortar as an exterior wall material, thereby completing the exterior wall. It is known to be very difficult to completely prevent water leakages through cracks or from around window openings from aged mortar-based exterior walls. Further, for the breathable vent layer construction method, various proposals have been made for providing highly durable structures calling for mounting a vent layer between an exterior wall and an insulating material to prevent dew formation and degradation in performance of the structure material. However, none of these proposals has been completely satisfactory.

For example, Japanese Patent Application Publication Kokai H08-120799 discloses a technology which comprises providing a vent layer panel constituting a vent structure within the wall generated between an exterior and an internal wall of a building wherein the vent panel has vent layers or vent holes running therethrough in an in-plane direction and through-holes that run through in an out-plane direction and cross the vent layers or holes. Also disclosed is sheet having moisture permeability and wind-breaking properties, which sheet is attached to one of the surfaces of the panel.

Japanese Patent Application Publication Kokai 2001-20398 discloses a waterproof surface material that can effectively prevent internal condensation on an exterior wall, can minimize the number of parts associated with exterior work to simplify the detailing of the exterior, and does not lose any waterproofing function by attaching exterior parts or tacker nail holes and the like. The material can suppress the formation of cracks due to an imbalance in coated thicknesses of a wet type exterior finishing material, wherein an asphalt compound layer is provided between the exterior base material and exterior finished material, wherein one side of the asphalt compound layer is provided, opposite to the exterior wall base material, with an indented and protruded surface by spot-forming multiple protrusions, thereby assuring that the gap between these protrusions can act as a path for water vapor diffusion and effectively prevent any internal condensation in the exterior wall.

DETAILED DESCRIPTION OF THE INVENTION

Figure 1:
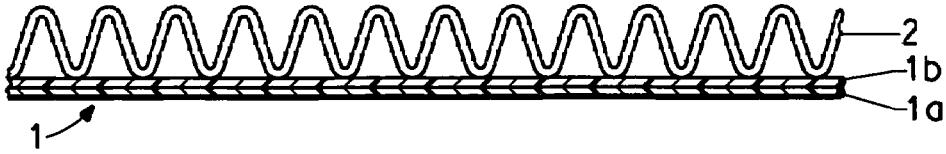
FIG. 1 is a schematic construction drawing for an example of the breathable waterproof structure of this invention.

Until this invention, there has been essentially no material that is a waterproof, moisture permeable, and breathable lightweight non-woven composite material with excellent workability and which sufficiently meets the needs for an exterior wall structure application. Further, such material can demonstrate superiority in cost compared to the conventional exterior wall structures.

The present invention addresses the problem of providing a breathable waterproof exterior wall structure for buildings and structures, which is comprised of a waterproof, moisture permeable, and breathable lightweight non-woven composite material with excellent processability. The exterior wall structure can discharge to the outside the water vapor contained in warm air entering from the interior of a structure into a wall, and from dew-condensation as cooled between the interior and the exterior wall. The exterior wall structure can also prevent the outdoor wind and rain from entering the inside of the wall and if such moisture should enter the interior of the wall, could discharge it to the outside. This invention can prevent the deterioration of the building or structural material that would limit the durability of such buildings and structures.

One embodiment of this invention is a breathable waterproof structure that is mounted on an exterior surface of a wall base material and comprises 1) a waterproof composite of a spun bonded non-woven sheet material with a resin layer coated on, or laminated to, an interior surface thereof; and 2) a vent layer-forming member of a corrugated spun bonded non-woven sheet material which is integrally attached to the waterproof layer by having multiple spot-adhered locations at the valleys of the corrugations, thereby generating the vent layer to form a designated gap with the waterproof layer.

Another embodiment of this invention is characterized in that the vent layer-forming member as noted above is formed by further spot-adhering, to an interior surface of the non-woven sheet material, a waterproof moisture permeable corrugated layer, at multiple spots thereof, and accommodates the contours of the vent layer-forming member.

This invention is further characterized in that the depth of the corrugations of the vent layer-forming member from ridge to valley is between 3 mm and 20 mm.

With this invention, not only can one achieve waterproofing and moisture permeability, but one can also substantially shorten the construction time relative to the conventional methods because the waterproof layer and vent layer-forming member are integrated. Further, in spite of a far simpler means of construction compared to the conventional vent construction method, the invention can discharge the water vapor contained in warm air entering from the indoors into the wall and water droplets from dew-condensation as cooled between the interior and exterior wall to the outside of the building. The invention can also prevent the outdoor wind and rain from entering the inside of the wall, and could, if such moisture should enter the interior of the wall, discharge them to the outside. Moreover, this invention provides properties similar to that of conventional materials.

Figure 2:
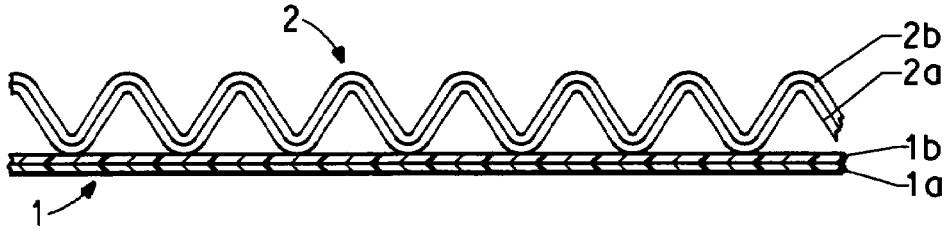
FIG. 2 is a schematic construction drawing for an example of the breathable waterproof structure of this invention.
Figure 3:
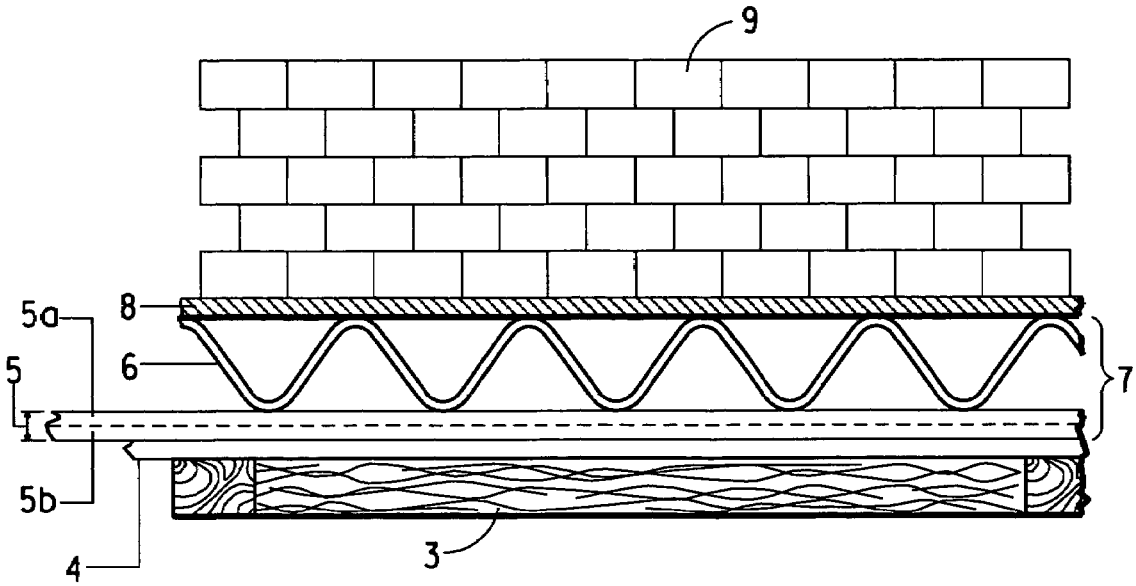
FIG. 3 illustrates the way the breathable waterproof structure in the present example is actually used as an exterior wall structure.

A description of the breathable waterproof structure of this invention is provided by reference to FIGS. 1 and 2. FIG. 3 depicts the actual way in which the breathable waterproof structure is used in an exterior wall structure. As illustrated in FIG. 1, a waterproof layer 1 is comprised of a spun bonded non-woven sheet material 1*a* with a resin layer 1*b* coated on, or laminated to, an interior surface thereof; and a vent layer-forming member 2 that is comprised of a corrugated-pattern spun bonded non-woven sheet material and is integrally attached to the waterproof layer and forms a designated gap with the waterproof layer 1.

The aforementioned spun-bonded non-woven fabrics can be manufactured by conventional manufacturing methods from conventional polypropylene, polyamide, and polyester, by melting these resins, extruding as fibers, taking up by an air sucker, distributing them on a net conveyor, and bonding them together. The preferred material for the spun-bonded non-woven fabrics is polypropylene in consideration of recyclability, chemical stability, and ease of disposal. A preferred polypropylene non-woven fabric is Xavan® available from E. I. du Pont de Nemours and Company, Wilmington, Del. (hereafter DuPont) to which this invention is not limited.

The non-woven fabric used should preferably have a unit area weight of 20 to 300 g/m$^2$ particularly 45 to 200 g/m$^2$, although weight reduction cannot be achieved unless the unit area weight is relatively low. The unit area weight of the non-woven fabric controls the strength when used as an actual exterior wall material and the ease of application (due to flexibility), so that if it is too light, the tensile strength will be insufficient due to insufficient unit area weight, tending to be easily torn, while if it is too thick, workability will be diminished.

As depicted in FIGS. 1 and 2, the resin layer 1*b*, which is part of the waterproof layer 1 of this invention and which is coated on, laminated onto or otherwise applied to, an interior side of nonwoven fabric 1*a* may be formed from thermoplastic resins. Polyolefin resins are generally preferred, for example, polyethylene, polypropylene, polyvinyl acetate, or their copolymers, to which this invention is not necessarily limited. Also, polystyrene, polyamide, polyester or polyacrylate can be used. For example, a layer which is waterproof and bondable to the vent layer-forming member can be prepared by laminating a 1.20 micrometer thick linear low density polyethylene (LLDPE) film with a polyethylene resin, for example, to the spun bonded non-woven fabric Xavan®.

The corrugated-pattern vent layer-forming member 2 which forms a vent layer with a designated gap with the above generated waterproof layer and which is integrally attached to the waterproof layer can be made of any spun-bonded, non-woven fabric or film that meets JIS (Japan Industrial Standard) A6111 or one which has the same function. As illustrated in FIG. 2, this can be prepared by laminating a non-porous film 2*b* made of polyvinyl alcohol resin to a spun-bonded non-woven fabric 2*a*, for example, Xavan® with dot adhesion with a conventional press at a platen surface temperature of 80° C. to 140° C. and a press pressure of 2 kg/cm$^2$ to 5 kg/cm$^2$ for 1 second, followed by pleating, thereby generating, throughout the entire surface of the non-woven fabric, corrugated wrinkles with about 5 to 12 millimeters (mm) distance from the valleys to the ridges. The resultant corrugated nonwoven fabric is bonded to the waterproof layer, thereby forming a vent layer therebetween, whereby water droplets that adhere to, or appear on, the non-woven fabric surface can travel downward generally in the vertically oriented valleys of the corrugations to the lowermost end of the structure.

The moisture permeable waterproof film 2*b* to be dot-adhered to the vent layer-forming member may be a moisture permeable waterproof film, which is a nonporous film, or a spun-bonded non-woven fabric. For example, it is possible to use a polyvinyl alcohol resin, polyamide resin, urethane resin, or the like. Alternatively, one may also use a micro-porous film with a large number of micropores within the film as prepared by adding a fine powder such as calcium carbonate or the like, for generation of micropores, followed by forming a film and drawing and leaching out the calcium carbonate. Use of a micro-porous film enables one to obtain a waterproof layer that has moisture permeability, air permeability, and waterproof capability.

Such a method permits the preparation of a moisture permeable film that has a moisture permeability of at least 500 g/m$^2$·24 hour or more, preferably, 800 g/m$^2$·24 hour or more, and water resistance to a hydraulic pressure of at least 30 mm $H_2O$ or higher, preferably 500 mm $H_2O$ or higher. The film used in this invention preferably has a thickness of 10 to 100 micrometers. A thickness of less than 10 micrometers is not sufficient in uniformity and strength as a film and tends to be torn when made into a vent layer-forming composite sheet, which is not preferred. A thickness exceeding 100 micrometers will cause moisture permeability to decrease when made into a composite material with a spun-bonded non-woven fabric, which is also not preferred in view of cost and workability.

The nonwoven fabric composite that constitutes the vent layer-forming member of this invention should have a moisture permeability, as measured under the customary measurement conditions of 40° C. and 90% relative humidity (RH) according to JIS Z-0208 (amended method), that meets, as mentioned above, JIS-A6111. Any material that has an equivalent function can be used.

In the breathable waterproof structure of this invention, the corrugated non-woven fabric or non-woven fabric composite sheet which is integrally attached to the waterproof layer to generate a vent layer needs to have unit area weight of 10 to 300 g/m$^2$ or less. It is self-evident that the unit weight as a whole should be as low as possible when used as an exterior wall structure. However, the present non-woven fabric is lightweight, free of elongation or shrinkage (when in contact with water) and is made of continuous fibers that do not fray or unravel from the edges. It is preferred that the total weight of the non-woven fiber sheet for breathable structures is preferably 600 g/m$^2$ or less, but the invention is not limited.

As illustrated in FIG. 3, an exterior wall can be formed by mounting a breathable waterproof structure 7 on the exterior surface of a sheet of plywood 4, which is placed on the exterior side of a glass wool insulation layer 3. Breathable waterproof structure 7 is made up of a waterproof layer 5 (same as 1 in FIGS. 1 and 2, respectively) and a corrugated vent layer forming member 6 (same as 2 or 2*a*/2*b* in FIGS. 1 and 2, respectively) which is integrally fixed to the waterproof layer 5, followed by attaching to the outside thereof a lath screen 8 and applying a mortar 9.

In the examples of this invention, the breathable waterproof structure of this invention is evaluated as follows:

a. Tensile Strength

JIS L-1096 (other conditions include sample width: 5 cm, a rate of extension: 1.0 cm/min., grip distance: 10 cm, test machine: a constant speed extension type)

b. Elongation

Similar to the tensile strength c. Tear Strength

JIS L-1096, A-1 (The Single tongue procedure)

d. Resistance to Hydraulic Pressure

JIS L-1099 method A (low hydraulic pressure method) hydrostatic pressure Procedure)

e. Evaluation of Water Flux of Vent Layer.

Figure 4A:
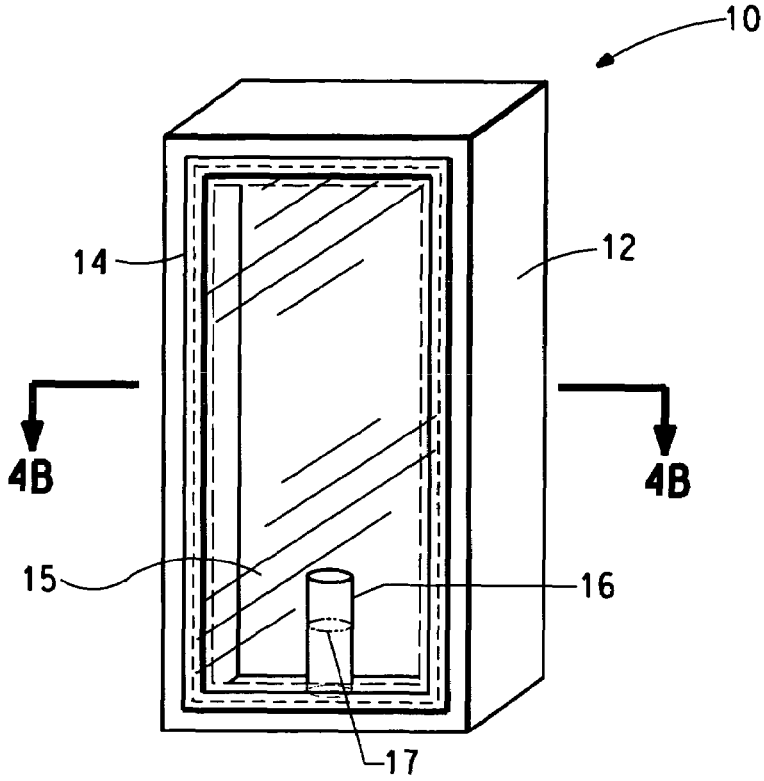
FIG. 4 is a drawing to illustrate the water flux test carried out on an example of the breathable waterproof structure of this invention.
Figure 4B:
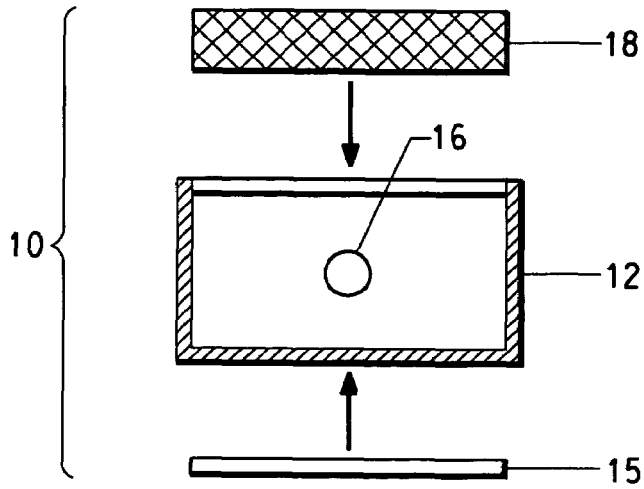

As illustrated in FIGS. 4A and 4B, a test apparatus unit 10 is made available to evaluate the performance of the various embodiments. Although not a requirement, the apparatus is made of wooden panels 12. An interior space is provided, with an open side surface of the interior space closed with an acrylic sheet 15 while on the other (open) side is placed the sample material 18 and, as applicable, the glass wool side of which faces the interior space. The acrylic sheet is held in place by aluminum tape 14 or other suitable sealing material. Water 17 is placed in a graduated cylinder 16 located in the test apparatus unit and the loss of water is measured in $cm^3$/hour by visually inspecting every 24 hours. The testing was done at Hokkaido Northern Regional Building Research Institute. The apparatus 10 was about 455 wide and 2481 mm long and the sample size was about 440 cm wide and 2470 cm long.

EXAMPLES

Example 1

A composite sheet was prepared by coating, at a unit area weight of 120 g/$m^2$, linear low density polyethylene (LLDPE) (made by Toso Company) to one side of a spun-bonded non-woven fabric "Xavan® 7331W" (unit area weight, 110 g/$m^2$). A waterproof layer was constructed from the resultant composite sheet. A piece of spun-bonded non-woven fabric "Xavan® 5401" (unit area weight, 136 g/$m^2$) as was corrugated with about 5 mm high ridges as a vent layer-forming member over the entire surface thereof by a corrugator so as to be melt-adhered to the LLDPE resin layer of the waterproof layer at a platen surface temperature of about 120° C., thereby generating a breathable waterproof structure of this invention. The resultant structure had a unit area weight of 454 g/$m^2$. The resultant breathable waterproof structure has properties as summarized in Table 1.

Example 2

A composite sheet was prepared as in Example 1. A piece of spun-bonded non-woven fabric Xavan® 7601" (unit area weight, 190 g/$m^2$) was corrugated with about 5 mm high ridges over the entire surface thereof by a corrugator so as to be melt-adhered to the LLDPE resin layer of the waterproof layer at a platen surface temperature of about 120° C., thereby generating a breathable waterproof structure of this invention. The resultant structure had a unit area weight of 480 g/$m^2$. The resultant breathable waterproof structure has properties as summarized in Table 1.

Additionally, when the water stoppage test as described below in Example 5 was performed on the waterproof layer used in this example, it was confirmed that the plywood sheet was dry after having had water passed over it.

Example 3

A composite sheet was prepared by coating, at a unit area weight of 120 g/$m^2$, linear low density polyethylene (LLDPE)(made by Toso Company) to one side of a spun-bonded non-woven fabric Xavan® 7137W" (unit area weight, 45 g/$m^2$). A waterproof layer was constructed from the resultant composite sheet. A piece of spun-bonded non-woven fabric Xavan® 5401" (unit area weight, 136 g/$m^2$) was dot-adhered with a 14 micrometer moisture-permeable film 9 thick comprising polyvinyl alcohol resin ("Bovlon"), made by the Nippon Synthetic Chemical Industry Co. Ltd and was corrugated with about 5 mm high ridges over the entire surface thereof by a corrugator so as to have the spun bonded nonwoven fabric melt-adhered to the LLDPE resin layer of the waterproof layer at a platen surface temperature of about 120° C., thereby generating a breathable waterproof structure of this invention. The resultant structure had a unit area weight of 369 g/$m^2$. The resultant breathable waterproof structure has properties as summarized in Table 1.

TABLE 1

| | | Example 1 | Example 2 | Example 3 |
|---|---|---|---|---|
| Waterproof Layer | Non-woven fabric | Xavan ® 7331W | Xavan ® 7331W | Xavan ® 7137W |
| | Resin Layer | LLDPE | LLDPE | LLDPE |
| Vent Layer Forming Member | | Xavan ® 5401 | Xavan ® 7601 | Xavan ® 5401/PVA film |
| Tensile Strength (N/5 cm) | Longitudinal | 311 | 362 | 200 |
| | Transverse | 913 | 1462 | 740 |
| Elongation (%) | Longitudinal | 30.8 | 23.8 | 27.4 |
| | Transverse | 50.8 | 47.3 | 48.2 |
| Tear Strength (N) | Longitudinal | 224 | 324 | 166 |
| | Transverse | 140 | 204 | 101 |
| Hydrostatic Resistance (Kpa) | | 5.0 | 7.8 | 7.7 |
| Unit Area Weight (g/$m^2$) | | 454 | 539 | 369 |

Comparative Example A

Figure 5A:
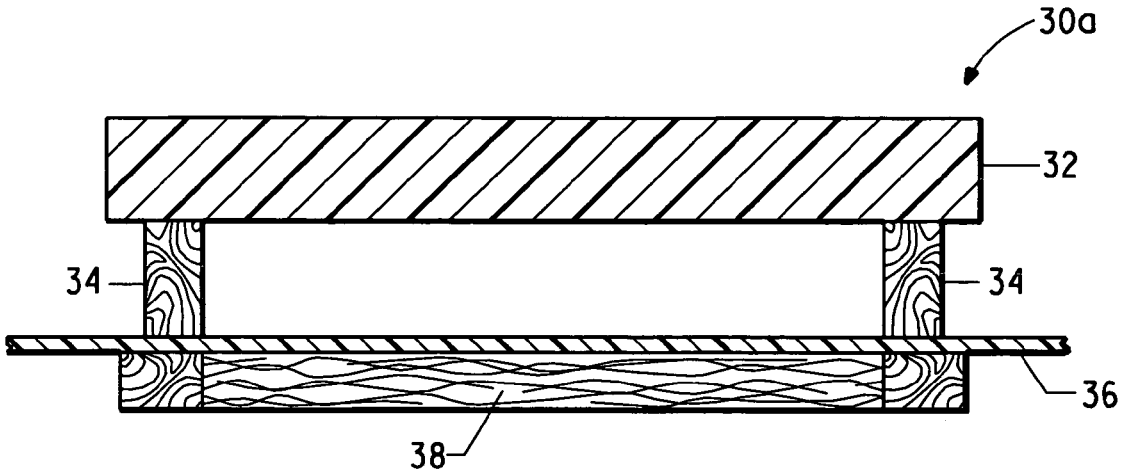
FIG. 5 is a drawing to illustrate the structure of a vent layer used for the water flux test carried out in this invention.

FIG. 5A depicts a vent layer structure 30*a* prepared by generating a 18 mm gap vent layer with conventional siding 32 and furring strips 34 and directly mounting, a sheet of Tyvek® (a flashspun non-woven fabric, available from DuPont) 36 on the glass wool layer 38. The water flux test showed a result of 120 cubic centimeters (cc)/day.

Comparative Example B

Figure 5B:
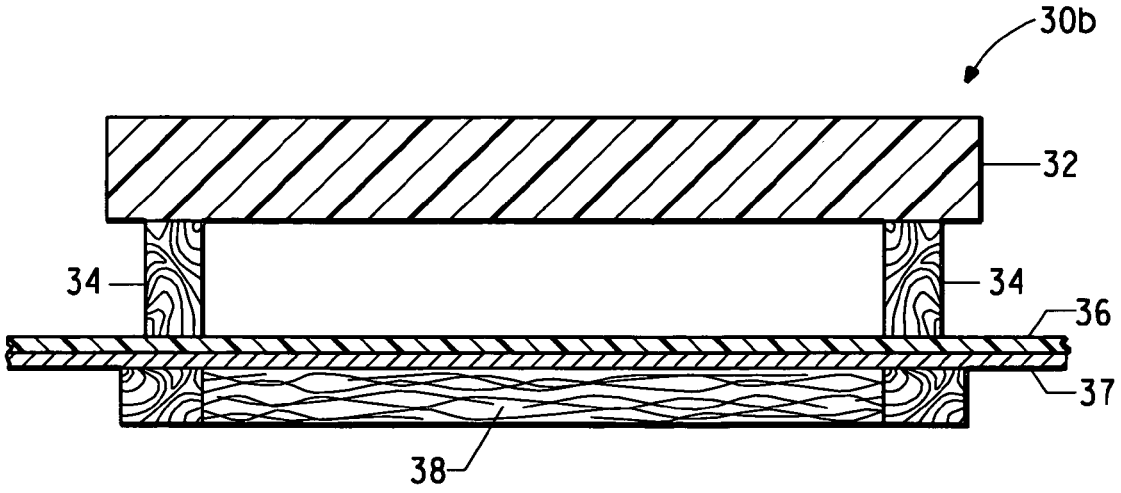

FIG. 5B depicts substantially the same vent layer structure 30*b* with an 18 mm gap vent layer as in Comparative Ex. A, except for the addition of a 9.5 mm thick plywood 37 on top of the sheet of Tyvek®. The water flux test showed a result of 65 cc/day.

Example 4

Figure 5C:
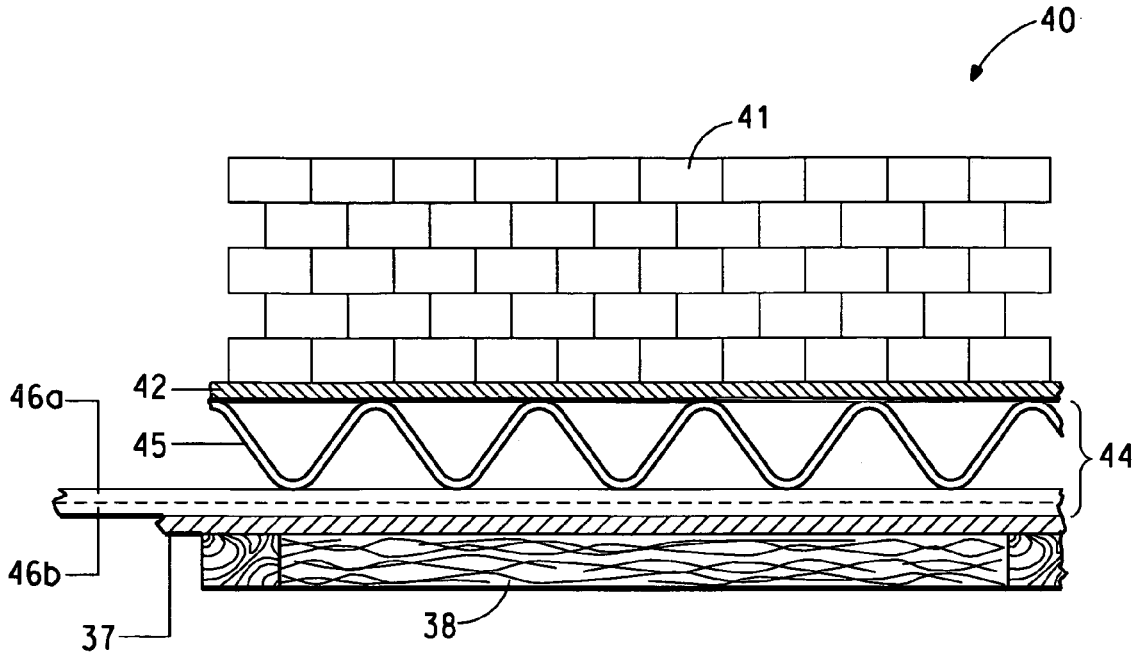

FIG. 5C depicts a structure 40 that replaces the siding as in the Comparative samples with 20 mm thick mortar 43 and furring strips. A breathable waterproof structure 44 (as in Example 1) was used with a 9.5 mm plywood 37, which was placed on top of the glass wool layer 38. The water flux test showed a result of 85 cc/day, which is a confirmation of about the same level of water flux as that of a conventional structure.

Example 5

Figure 6:
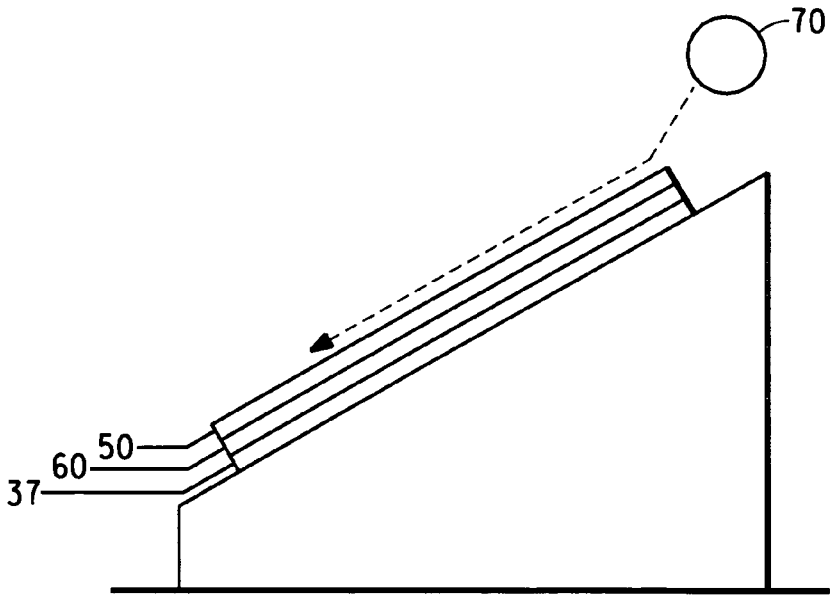
FIG. 6 is a drawing to illustrate the water stoppage test carried out on an example of the breathable waterproof structure of this invention.

To evaluate water stoppage, a piece of plywood 37 at about a 30% slope as depicted in FIG. 6 had attached to it a composite sheet prepared by applying a linear low density polyethylene (LLDPE) sheet 50 (made by Toso Company) at a unit area weight of 120 g/m$^2$ onto one surface of a sheet 60 of Xavan® 7331W" (unit area weight, 110 g/m$^2$). Then water was caused to flow, as indicated by arrows, from a polyvinyl chloride pipe 70 that had been struck with a tacking nail to make holes (about 2 mm in diameter) as defined by JIS A61111. The water was allowed to flow for about 2 hours at a rate of 1000 cc/min and at a hydrostatic pressure of 0.5 kg/cm$^2$. After which, the composite sheet was removed and the condition of the plywood sheet was observed. The plywood was observed to have remained dry.

What is claimed is:

1. A breathable waterproof structure, comprising a waterproof layer, mounted on an exterior wall side, that is a composite of a spun bonded non-woven sheet material with a resin layer on an interior surface of the sheet material; and a vent layer-forming member comprised of a corrugated spun bonded non-woven sheet material that is integrally attached to the waterproof layer by being multiply spot-adhered via the valleys thereof, thereby generating the vent layer with a designated gap with the waterproof layer, wherein the vent layer-forming member is formed by further spot-adhering to an interior side surface of the non-woven sheet material, a waterproof moisture permeable corrugated layer, at multiple spots thereof, the waterproof moisture permeable corrugated layer accommodating the contour of the vent layer-forming member.

2. The breathable waterproof structure as set forth in claim 1, wherein the depth of the corrugations from valley to ridge of the vent layer-forming member is about 3 mm to 20 mm.

3. The breathable waterproof structure as set forth in claim 1, wherein the nonwoven sheet material comprises filaments selected from the group consisting of polypropylene, polyamide, and polyester.

4. The breathable waterproof structure as set forth in claim 1, wherein the resin layer is selected from the group consisting of polyethylene, polypropylene, polyvinyl acetate, polystyrene, polyamide, polyester, polyacrylate and their copolymers.

5. The breathable waterproof structure as set forth in claim 1, wherein the waterproof moisture permeable corrugated layer is made of a material selected from the group consisting of a polyvinyl alcohol resin, polyamide resin and urethane resin.

* * * * *